US012295449B1

(12) United States Patent
Huangfu et al.

(10) Patent No.: US 12,295,449 B1
(45) Date of Patent: May 13, 2025

(54) ARTICLE OF FOOTWEAR INCORPORATING AN UPPER ASSEMBLY

(71) Applicant: NIKE, Inc., Beaverton, OR (US)

(72) Inventors: Chaokun Huangfu, Portland, OR (US); Kevin Reyes, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/510,117

(22) Filed: Nov. 15, 2023

Related U.S. Application Data

(60) Provisional application No. 63/426,515, filed on Nov. 18, 2022.

(51) Int. Cl.

| | |
|---|---|
| ***A43B 1/04*** | (2022.01) |
| ***A43B 7/06*** | (2006.01) |
| ***A43B 23/02*** | (2006.01) |
| ***A43B 23/26*** | (2006.01) |

(52) U.S. Cl.
CPC ..... *A43B 1/04* (2013.01); *A43B 7/06* (2013.01); *A43B 23/0205* (2013.01); *A43B 23/0245* (2013.01); *A43B 23/26* (2013.01)

(58) Field of Classification Search
CPC .. A43B 1/04; A43B 23/26; A43B 7/06; A43B 7/08; A43B 7/085
USPC ..... 36/3 R, 3 A
See application file for complete search history.

(56) References Cited

U.S. PATENT DOCUMENTS 5,365,677 A * 11/1994 Dalhgren ..... D04B 1/26 36/3 A
2012/0124863 A1* 5/2012 Aveni ..... A43B 23/26 36/50.1
2014/0352179 A1* 12/2014 Bell ..... A43B 23/028 66/170
2015/0068061 A1* 3/2015 Farris ..... A43C 5/00 36/83
2015/0282565 A1 10/2015 Kilgore
(Continued)

FOREIGN PATENT DOCUMENTS

CN 111051589 A 4/2020
TW 201600036 A 1/2016
(Continued)

OTHER PUBLICATIONS

International Search Report and Written Opinion received for PCT Patent Application No. PCT/US2023/080044, mailed on Feb. 19, 2024, 9 pages.

*Primary Examiner* — Marie D Bays
(74) *Attorney, Agent, or Firm* — Shook, Hardy & Bacon L.L.P.

(57) ABSTRACT

Aspects herein are directed toward an upper assembly for an article of footwear that includes a knit element that extends from a throat area to a lower area of the upper assembly along at least a medial side and a lateral side of the upper assembly. The knit element includes a first plurality of aperture groupings. The upper assembly further includes a tongue that extends across the throat area and extends along at least a portion of the medial side and/or the lateral side of the upper assembly to the lower area of the upper assembly. The tongue comprises a second plurality of aperture groupings. The apertures in the second plurality of aperture groupings are axially aligned with at least a portion of the apertures in the first plurality of aperture groupings.

20 Claims, 7 Drawing Sheets

(56) References Cited

U.S. PATENT DOCUMENTS

| | | | | |
|---|---|---|---|---|
| 2015/0342284 | A1* | 12/2015 | Huffman | A43B 23/042 66/170 |
| 2015/0342285 | A1* | 12/2015 | Huffman | A43B 23/0245 66/170 |
| 2015/0342286 | A1* | 12/2015 | Huffman | A43D 9/00 66/170 |
| 2017/0135435 | A1* | 5/2017 | Ikenaka | D04B 1/22 |
| 2018/0177260 | A1 | 6/2018 | Bell et al. | |
| 2018/0213884 | A1* | 8/2018 | Kim | A43B 13/127 |
| 2019/0037966 | A1 | 2/2019 | Aceves et al. | |
| 2020/0170349 | A1 | 6/2020 | Verfl et al. | |
| 2024/0023676 | A1* | 1/2024 | Tateno | A43B 23/26 |

FOREIGN PATENT DOCUMENTS

| | | | |
|---|---|---|---|
| TW | 202042688 | A | 12/2020 |
| TW | 202103597 | A | 2/2021 |
| WO | 2015/183349 | A1 | 12/2015 |
| WO | 2019/001676 | A1 | 1/2019 |

* cited by examiner

ARTICLE OF FOOTWEAR INCORPORATING AN UPPER ASSEMBLY

CROSS-REFERENCE TO RELATED APPLICATIONS

This application claims the benefit of U.S. Provisional Patent Application No. 63/426,515, filed on Nov. 18, 2022, the entirety of which is hereby incorporated by reference.

TECHNICAL FIELD

Aspects herein relate to a knitted upper assembly for an article of footwear.

BACKGROUND

Conventional articles of footwear generally include an upper and a sole structure. The upper is secured to the sole structure and forms a void on the interior of the footwear for comfortably and securely receiving a foot. Conventional uppers, including knit uppers, may stretch and abrade over time, which may decrease their useable life. In some instances, multiple material elements may be layered on top of each other to limit stretch and/or to provide abrasion resistance to select areas of the upper. However, the layering of the material elements may reduce air permeability and breathability of the upper, which may cause wearer discomfort.

BRIEF DESCRIPTION OF THE DRAWINGS

Examples of aspects herein are described in detail below with reference to the attached drawing figures, wherein.

DETAILED DESCRIPTION

Figure 1:
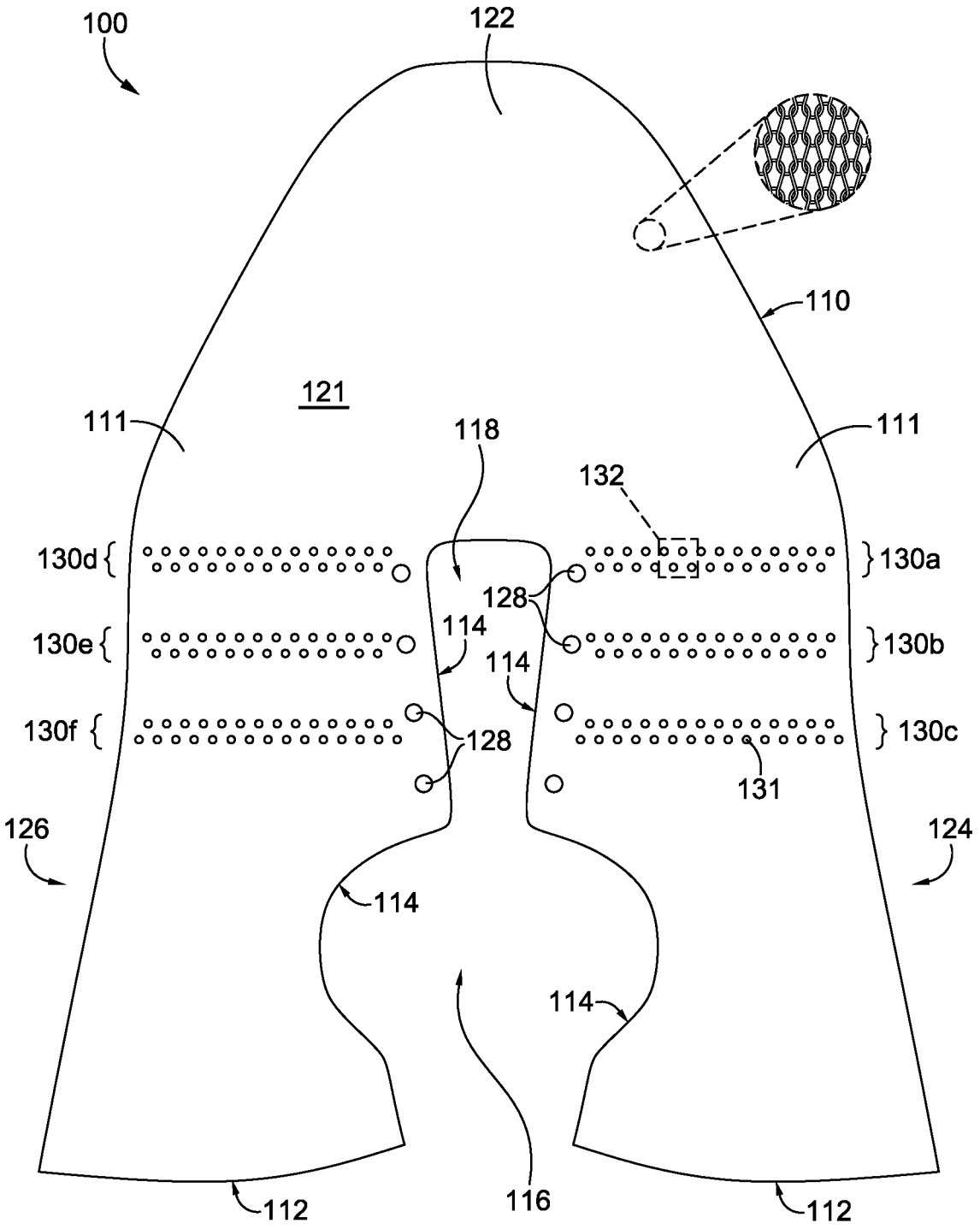
FIG. 1 illustrates a top plan view of a knit element that forms a portion of an upper assembly for an article of footwear in accordance with aspects herein.

Conventional articles of footwear generally include an upper and a sole structure. The upper is secured to the sole structure and forms a void on the interior of the footwear for comfortably and securely receiving a foot. Conventional uppers, including knit uppers, may stretch and abrade over time, which may decrease their useable life. In some instances, multiple material elements may be layered on top of each other to limit stretch and/or to provide abrasion resistance to select areas of the upper in order to increase the useable life of the article of footwear. However, the layering of the material elements may reduce air permeability and breathability of the upper, which may cause wearer discomfort.

At a high level, aspects herein are directed toward an upper assembly for an article of footwear that increases support and fit in select areas of the upper as well as increases durability and resistance to abrasion while maintaining permeability and breathability for wearer comfort. The upper assembly includes a knit element that defines at least a portion of an exterior surface of the upper assembly. The knit element extends from a throat area to a lower area of the upper assembly along at least a medial side, a lateral side, and a toe area of the upper assembly. The knit element includes a first plurality of aperture groupings that extend from the throat area to the lower area along the medial and lateral sides of the upper assembly. The upper assembly further includes a tongue, which may also comprise a knit construction that includes elastic yarns. The tongue defines at least a portion of an interior surface of the upper assembly. The tongue extends across the throat area and further extends along at least a portion of the medial side and the lateral side of the upper assembly to the lower area of the upper assembly. The tongue comprises a second plurality of aperture groupings that also extend from the throat area to the lower area along the medial and lateral sides of the upper assembly. The apertures in the second plurality of aperture groupings are axially aligned with at least a portion of the apertures in the first plurality of aperture groupings such that a fluid communication path is formed between an interior of the article of footwear and an environment external to the article of footwear. As used herein, the term "axially aligned," with reference to apertures, refers to the apertures on the tongue and the knit element being spatially aligned along a common axis, where that axis extends through the width of the tongue and knit element as described in more detail with respect to FIG. 4.

The tongue and the knit element are selectively secured to each other. For example, the tongue and the knit element may be secured to each other at the lower area of the upper assembly on each of the medial side and the lateral side. In further example aspects, the tongue and the knit element may be secured to each other at a forward portion of the throat area. Remaining portions of the tongue are not secured to the knit element, which allows for some movement or shifting of the tongue relative to the knit element. This may facilitate wearer comfort by lessening tension forces on the wearer's foot during certain athletic activities that cause shifting of the foot within the upper. To decrease the likelihood of the apertures in the knit element and the tongue from becoming misaligned due to shifting between the two layers, in example aspects, the number of apertures per unit area in the tongue is greater than the number of apertures per unit area in the knit element. This increases the probability that at least some of the apertures in the tongue are axially aligned with at least some of the apertures in the knit element. Moreover, by minimizing the number of apertures in the knit element relative to the tongue, greater structural integrity and resistance to environmental elements (e.g., dirt, pebbles, rain, and the like) is imparted to the knit element.

The positioning of the tongue and its use of elastic yarns creates an additional level of fit and support along the medial and lateral sides of the upper assembly in at least the midfoot region of the article of footwear. The layered configuration may further make the upper assembly more resistant to abrasion and wear-and-tear, thereby increasing the useful life of the article of footwear. The axially aligned apertures in the tongue and the knit element minimize heat and moisture retention, which improves wearer comfort.

As used herein, an article of footwear generally includes a sole structure secured to an upper or an upper assembly. The article of footwear described herein may comprise a running shoe, a baseball shoe, a basketball shoe, a cycling shoe, a football shoe, a tennis shoe, a soccer shoe, a training shoe, a walking shoe, a hiking shoe, and the like. The concepts described herein may also be applied to other footwear types that are considered non-athletic, such as dress shoes, loafers, sandals, and work boots. As used herein, the article of footwear and/or upper assembly may be divided into different general regions. A forefoot region generally includes portions of the article of footwear and/or upper assembly that corresponds to the toes and joints connecting the metatarsals with the phalanges. A midfoot region generally includes portions of the article of footwear and/or upper assembly corresponding with an arch area and an instep area of the foot. A heel region generally corresponds with rear portions of the foot including, the calcaneus bone. The upper assembly and article of footwear described herein may include a lateral side, which corresponds with an outside area of the foot (i.e., the surface that faces away from the other foot), and a medial side, which corresponds with an inside area of the foot (i.e., the surface that faces toward the other foot). The different regions and sides described above are intended to represent general areas of footwear to aid in the following discussion and are not intended to demarcate precise areas. The different regions and sides may be applied to the article of footwear as a whole, to the upper assembly, and to the sole structure.

The term "exterior" as used herein means a surface of the upper assembly or article of footwear that faces the external environment. In some aspects, the exterior surface may mean the outermost surface of the upper assembly or article of footwear. The term "interior" as used herein means a surface of the upper assembly or article of footwear that faces a void for receiving the wearer's foot. In some aspects, the interior surface may mean the innermost surface of the upper assembly or article of footwear.

The term "aperture" as used herein means a hole or perforation that extends through the thickness of a material or layer to form a through-passage. When the term "aperture" is used with respect to a knit construction, the aperture is formed by one or more of altering a knit pattern to intentionally form the aperture or forming the aperture in a post-knitting step by, for instance, punching, melting, dissolving, etc., the knit material. With respect to aspects herein, the term "aperture" does not mean the spaces between interlooped yarns that are inherently and unintentionally formed by the standard knitting process. As used herein, the term "aperture grouping" means two or more apertures that are arranged in a pattern where the pattern may comprise a band of apertures (e.g., one or more lines of apertures), as well as other shapes such as circles, triangles, squares, and the like.

The term "elastic yarn" as used herein refers to yarns (e.g., spandex, thermoplastic polyurethane, elastane, and the like) that stretch in response to a tension force and return to their resting state once the tensioning force is removed. In example aspects, the yarns may stretch from about 100% to 200% of their resting length.

Unless indicated otherwise, all measurements provided herein are taken when the upper assembly and/or article of footwear is at standard ambient temperature and pressure (298.15 K and 100 kPa) and is in a resting (non-tensioned) state.

FIG. 1 depicts a knit element 100 that is part of an upper assembly. The knit element 100 is formed from at least one yarn that is manipulated (e.g., with a knitting machine) to form a plurality of intermeshed loops that define a variety of courses and wales. The knit element 100 may be formed of a unitary knit construction. As used herein, the term "unitary knit construction" means a one-piece element that is formed through a knitting process where the knitting process substantially forms the various features and structures of the knit element 100 without the need for significant additional manufacturing steps or processes. Aspects herein contemplate that portions of the knit element 100 may be joined to each other (e.g., edges of the knit element 100 being joined together) following the knitting process.

The knit element 100 has a generally U-shaped configuration that is outlined by a perimeter edge 110, a pair of heel edges 112, and an inner edge 114. When incorporated into an article of footwear, the perimeter edge 110 may be positioned against the upper surface of the sole structure and may be joined to a strobel in example aspects. As such, the perimeter edge 110 may be adjacent a bite line (e.g., bite line 524 of FIG. 5) where the upper assembly meets the sole structure. In other aspects, the knit element 100 may include an underfoot portion. In this example, the article of footwear may not include a strobel. When incorporated into an article of footwear, the perimeter edge 110 and areas adjacent to the perimeter edge 110 may be referred to as a lower area 111 of the knit element 100 and/or upper assembly. In example aspects, the pair of heel edges 112 are joined to each other and extend generally vertically in a heel region of the article of footwear. The inner edge 114 forms an ankle opening 116 and extends forward to define a throat area 118. The knit element 100 has a first surface 121 and an opposite second surface (not shown in FIG. 1 but depicted in FIG. 4). As discussed below, the first surface 121 forms a portion of an exterior surface of the upper assembly and, in example aspects, may form a portion of an outermost surface of the upper assembly. The opposite second surface forms a portion of an interior surface of the upper assembly, and, in example aspects, may form a portion of an innermost surface of the upper assembly.

The knit element 100 includes a toe area 122, a medial side 124, and a lateral side 126. In example aspects, the knit element 100 extends from the throat area 118 to the lower area 111 along at least the medial side 124, the lateral side 126, and the toe area 122. The knit element 100 further optionally includes lace apertures 128 positioned adjacent to the throat area 118 and configured to receive a lace for adjusting the girth of an article of footwear incorporating the knit element 100. In example aspects, the toe area 122 may include one or more structures/yarns that provide reinforcement or rigidity to this area. For example, the toe area 122 may incorporate yarns comprising a thermoplastic elastomer that can be heated and re-solidified to create a thermoformed network of interlooped yarns. In other examples, the toe area 122 may include high-tenacity yarns for abrasion resistance. In yet another example, a polymer skin or other material layer may be applied to the toe area 122 for reinforcement and/or rigidity. Additional ways of imparting reinforcement and/or abrasion resistance to the toe area 122 that are known in the art are contemplated herein.

In example aspects, the knit element 100 includes a first plurality of aperture groupings 130, such as aperture groupings 130*a*, 130*b*, and 130*c* on the medial side 124 of the knit element 100, and aperture groupings 130*d*, 130*e*, and 130*f* on the lateral side 126 of the knit element 100. Each of the aperture groupings 130*a-c* on the medial side 124 is separated from an adjacent aperture grouping on the medial side 124 by an intervening portion of knit material without apertures, and each of the aperture groupings 130*d-f* on the lateral side 126 is separated from an adjacent aperture grouping on the lateral side 126 by an intervening portion of knit material without apertures. In this way, aperture groupings 130*a-f* are visually distinct from one another. The aperture groupings 130*a-c* extend generally from the throat area 118 to the lower area 111 on the medial side 124, and the aperture groupings 130*d-f* extend generally from the throat area 118 to the lower area 111 on the lateral side 126. Each of the aperture groupings 130*a-f* includes a first set of apertures, such as aperture 131, that extends through the thickness of the knit element 100 to form a through-passage. Unlike lace apertures 128, apertures within the first plurality of aperture groupings 130 are not intended to receive a lace.

Each aperture grouping, such as the aperture grouping 130*a*, includes a first number of apertures per unit area, as indicated by unit area 132. The unit area 132 may be, for example, a 1-by-1-cm square. The apertures 131 may range in size from about 0.5 mm to about 5 mm. As used herein, the term "about" means within +10% of an indicated value. The depiction of the number of aperture groupings, the spacing of apertures within a given aperture grouping, the number of apertures within a given aperture grouping, the size of individual apertures, and the spacing between adjacent aperture groupings is illustrative, and aspects herein contemplate different configurations.

Figure 2A:
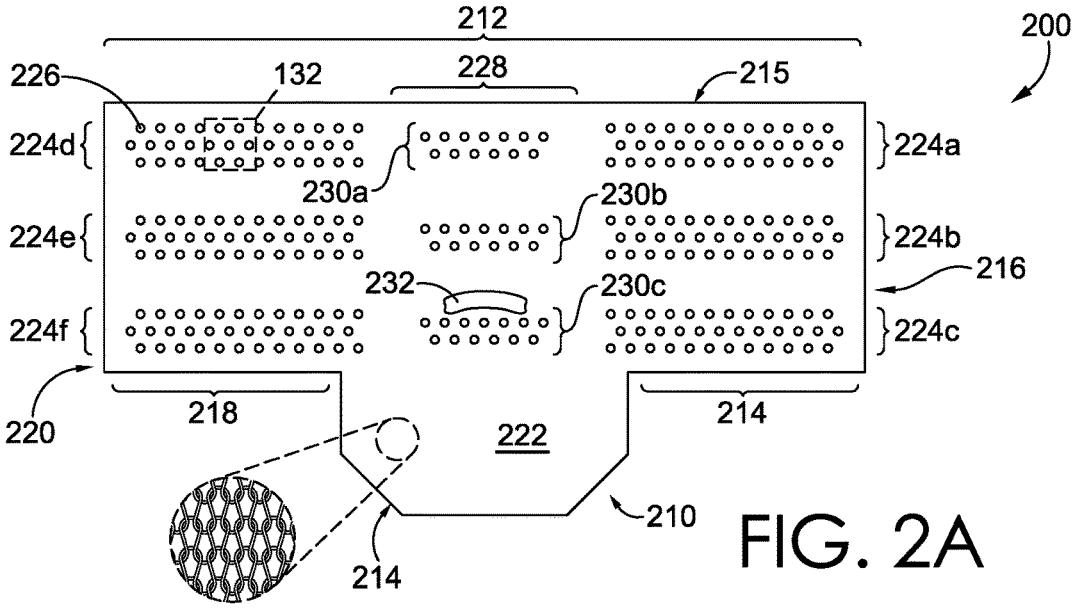
FIG. 2A illustrates a top plan view of a first example tongue that forms a portion of the upper assembly for the article of footwear in accordance with aspects herein.

FIG. 2A depicts a first example tongue 200 that is part of the upper assembly. In example aspects, the tongue 200 is also formed from at least one yarn that is knitted to form a plurality of intermeshed loops that define a variety of courses and wales. The tongue 200 may also comprise a unitary knit construction. Aspects herein contemplate that the tongue 200 may be knit using one or more elastic yarns such that the tongue 200 is elastically resilient. Aspects herein contemplate that the tongue 200 may be knit in a knitting event separate from the knit element 100 and later joined to the knit element 100 in a post-knitting processing step. Other aspects herein contemplate that the tongue 200 and the knit element 100 may be knit together in a single knitting event such that the tongue 200 and the knit element 100 share at least one knit course in common. Aspects herein further contemplate that the tongue 200 may be formed from a non-knit element (e.g., a woven element, a polymer element, a nonwoven element, and the like).

The tongue 200 is depicted as having a generally T-shaped configuration with a stem 210 and an arm 212. As described below, when incorporated into an article of footwear, the stem 210 of the T-shape of the tongue 200 generally extends across the throat area 118 of the knit element 100 and in a direction toward the ankle opening 116. The arm 212 of the T-shape of the tongue 200 includes a medial arm 214 terminating in a medial arm edge 216 and a lateral arm 218 terminating in a lateral arm edge 220. When the tongue 200 and the knit element 100 are joined or otherwise both incorporated into an upper assembly, the medial arm 214 of the tongue 200 extends to the lower area 111 and/or perimeter edge 110 of the knit element 100 on the medial side 124, and the lateral arm 218 of the tongue 200 extends to the lower area 111 and/or perimeter edge 110 of the knit element 100 on the lateral side 126. In example aspects, the medial arm edge 216 is secured to the lower area 111 and/or the perimeter edge 110 of the knit element 100 on the medial side 124, and the lateral arm edge 220 is secured to the lower area 111 and/or the perimeter edge 110 of the knit element 100 on the lateral side 126. In another example, the medial arm edge 216 and the lateral arm edge 220 of the tongue 200 and the perimeter edge 110 and/or lower area 111 of the knit element 100 are each directly coupled to the strobel or other sole structure, and the tongue 200 and the knit element 100 are not otherwise directly coupled together.

Figure 4:
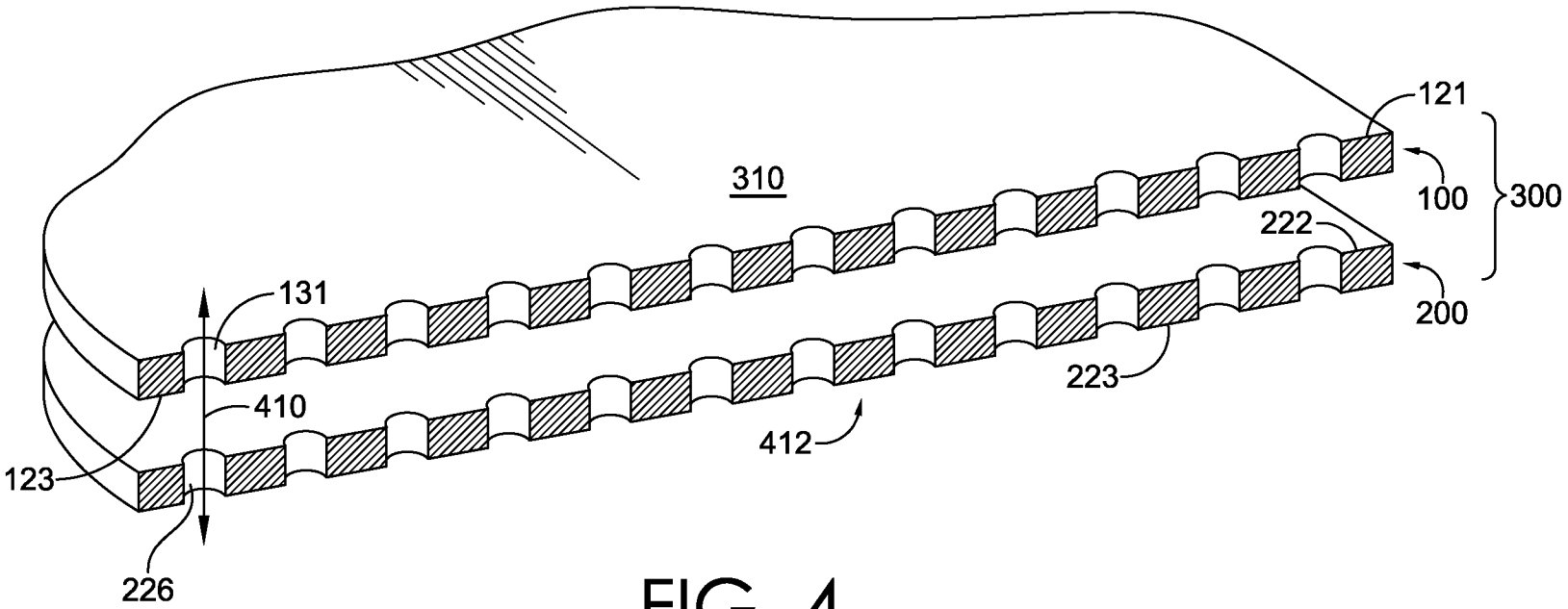
FIG. 4 illustrates a cross-section taken at cut line 4-4 of FIG. 3A and depicts the axial alignment of apertures in the knit element and the tongue in accordance with aspects herein.

The tongue 200 includes a first surface 222 and an opposite second surface (not shown in FIG. 2A but depicted in FIG. 4). The first surface 222 of the stem 210 forms a portion of the exterior surface of the upper assembly, and may form a portion of the outermost surface of the upper assembly in the throat area 118. The opposite second surface of the tongue forms a portion of the interior surface of the upper assembly, and, in example aspects, may form a portion of the innermost surface of the upper assembly in the throat area 118 and along portions of the medial side 124 and the lateral side 126 where the medial arm 214 and the lateral arm 218 extend.

In example aspects, the tongue 200 includes a second plurality of aperture groupings 224, such as aperture groupings 224*a*, 224*b*, and 224*c* on the medial arm 214 of the tongue 200, and aperture groupings 224*d*, 224*e*, and 224*f* on the lateral arm 218 of the tongue 200. Each of the aperture groupings 224*a-c* is separated from an adjacent aperture grouping on the medial arm 214 by an intervening portion of knit material without apertures, and each of the aperture groupings 224*d-f* is separated from an adjacent aperture grouping on the lateral arm 218 by an intervening portion of knit material without apertures. The aperture groupings 224*a-c* extend generally from the stem 210 to an area adjacent the medial arm edge 216 on the medial arm 214, and the aperture groupings 224*d-f* extend generally from the stem 210 to an area adjacent the lateral arm edge 220 on the lateral arm 218.

Each of the aperture groupings 224*a-f* includes a second set of apertures, such as aperture 226, that extends through the thickness of the tongue 200 to form a through-passage. Unlike lace apertures 128, the apertures within the second plurality of aperture groupings 224 are not intended to receive a lace. Each aperture grouping, such as the aperture grouping 224*d*, includes a second number of apertures per unit area, as indicated by the unit area 132. In example aspects, the second number of apertures per unit area in the tongue 200 is greater than the first number of apertures per unit area of the knit element 100. The apertures 226 may range in size from about 0.5 mm to about 5 mm and may be the same or a different size than the apertures 131. The depiction of the number of aperture groupings, the spacing of apertures within a given aperture grouping, the size of the apertures, the number of apertures within a given aperture grouping, and the spacing between adjacent aperture groupings is illustrative, and aspects herein contemplate different configurations. As explained in greater detail below with reference to FIG. 4, the second plurality of aperture groupings 224 of the tongue 200 is axially aligned with at least a portion of the first plurality of aperture groupings 130 such that one or more through-passages are maintained between an interior of the upper assembly (in which the wearer's foot resides) and an external environment to allow for the exhaustion of heat and moisture from the wearer's foot to the external environment.

The arm 212 of the tongue 200 may include a central portion 228 between the medial arm 214 and the lateral arm 218. When arranged with the knit element 100 to form the upper assembly, the central portion 228 of the arm 212 may be located in the throat area 118 and thus may form a portion of the exterior surface of the upper assembly. For example, when arranged with the knit element 100, the knit element 100 may cover the medial arm 214 and the lateral arm 218 of the tongue 200, while the central portion 228 may be not covered by the knit element 100 such that the central portion 228 may form an exterior surface of the upper assembly.

In example aspects, the central portion 228 may also include aperture groupings such as aperture groupings 230*a*, 230*b*, and 230*c*, each of which comprises apertures that extend through the thickness of the tongue 200. In example aspects, the aperture grouping 230*a* may be linearly aligned with the aperture groupings 224*a* and 224*d*, the aperture grouping 230*b* may be linearly aligned with the aperture groupings 224*b* and 224*e*, and the aperture grouping 230*c* may be linearly aligned with the aperture groupings 224*c* and 224*f* along the length of the arm 212. Other aspects contemplate that the aperture groupings 230*a-c* may not be linearly aligned with the aperture groupings 224*a-f*. Any and all aspects, and any variation thereof, are contemplated as being within the scope herein. Because the throat area 118 of the upper assembly comprises a single layer of material (i.e., the central portion 228 of the tongue 200), the aperture groupings 230*a-c* form a fluid communication path between an interior of the upper assembly and the external environment and provide for an additional egress point for heat and moisture to be exhausted to the external environment. In other examples, the tongue 200 includes apertures only on the medial arm 214 and lateral arm 218, where the central portion 228 lacks apertures.

In example aspects, the central portion 228 may optionally include one or more lace tunnels 232. The lace tunnel 232, for example, may be integrally knit in that it is formed by coextensive knit layers within the tongue 200, where the knit layers are at least partially separable to create the lace tunnel 232. A portion of the lace extending over a central portion of the tongue 200 may extend through the lace tunnel 232, which may help maintain proper placement of the lace. While FIG. 2 depicts only one lace tunnel 232, it is contemplated that the arm 212 of the tongue 200 may include multiple lace tunnels 232 linearly aligned along the length of the arm 212. In other aspects, the arm 212 may include one or more lace loops formed by an inlaid yarn that is exposed along the first surface 222. In example aspects, the tongue 200 may not include lace apertures within the structure of the tongue 200, such as the lace apertures 128.

Figure 2B:
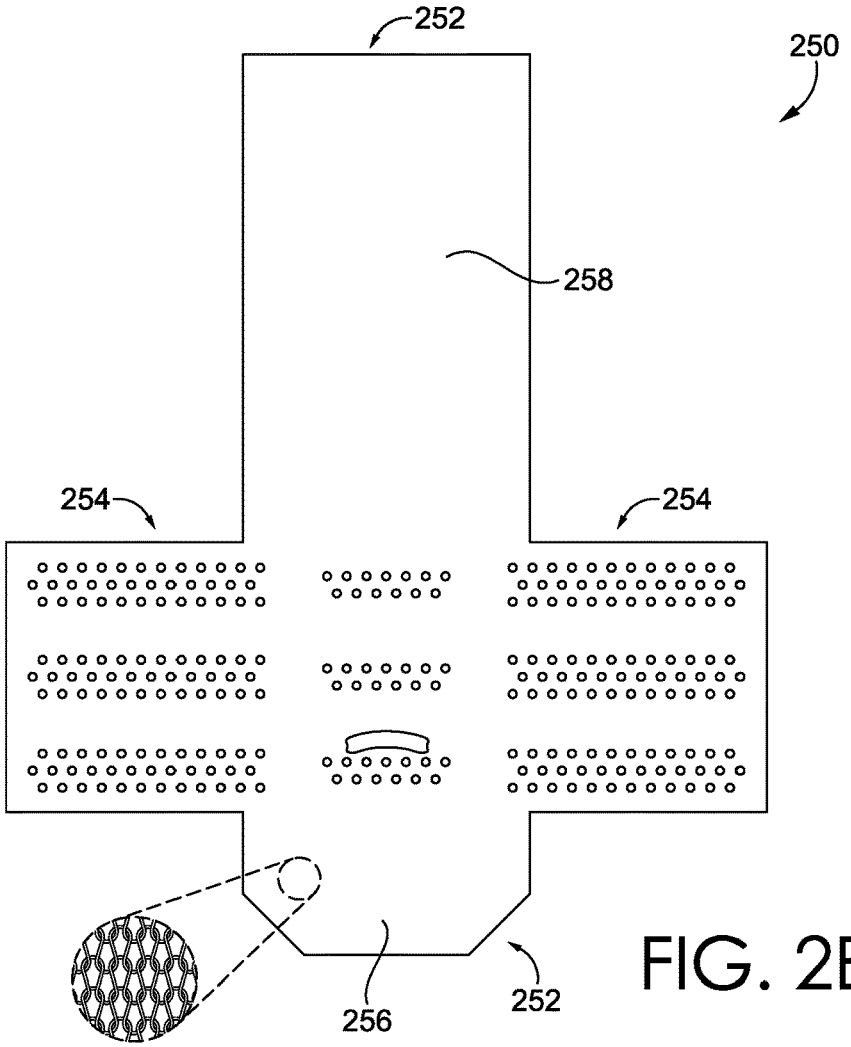
FIG. 2B illustrates a top plan view of a second example tongue that forms a portion of the upper assembly for the article of footwear in accordance with aspects herein.

FIG. 2B depicts a second example tongue 250 having a cross-shaped configuration with a vertical bar 252 and a horizontal bar 254. The vertical bar 252 includes a proximal portion 256 that extends across the throat area 118 of the knit element 100 and in a direction toward the ankle opening 116. The vertical bar 252 further includes a distal portion 258 that extends into the toe area 122 of the knit element 100 and is configured to be positioned internal to the knit element 100. The distal portion 258 may provide additional reinforcement and abrasion resistance to the toe area 122 of the knit element 100 and may increase the useable life of an article of footwear incorporating the upper assembly. Additionally, in some aspects, the tongue 250 may include another set of apertures within the distal portion 258, where the apertures in the distal portion 258 may axially align with apertures within the knit element 100 to maintain through-passages between an interior of the upper assembly (in which the wearer's foot resides) and an external environment to allow for the exhaustion of heat and moisture from the wearer's foot to the external environment within the toe region.

The horizontal bar 254 corresponds to the arm 212 of the tongue 200 and includes the aperture groupings and the optional loop(s) discussed above with respect to the tongue 200. For brevity's sake, the discussion regarding the aperture groupings will be omitted with respect to the tongue 250.

Figure 3A:
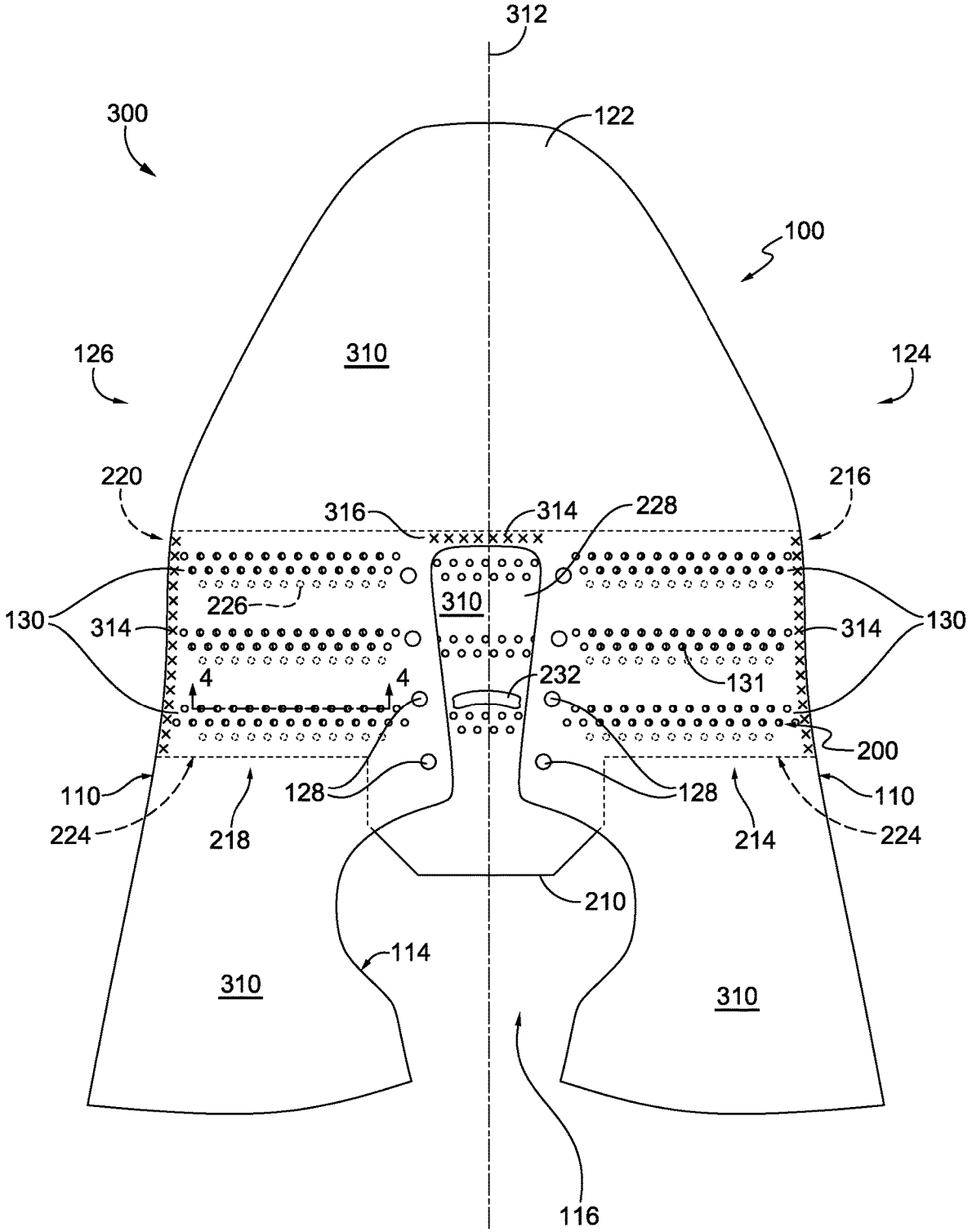
FIG. 3A illustrates a top plan view of the first example tongue of FIG. 2A positioned interior to the knit element of FIG. 1 to form the upper assembly for the article of footwear in accordance with aspects herein.

FIG. 3A depicts an upper assembly 300 comprising the knit element 100 and the tongue 200. The tongue 200 is positioned interior to the knit element 100 (i.e., closer to a wearer's foot), and portions of the tongue 200 that are not visible when viewing the exterior surface of the upper assembly 300 are shown in dashed line. As depicted, the stem 210 and the central portion 228 of the tongue 200 extend across the throat area 118 and form a portion of an exterior surface 310 of the upper assembly 300. Remaining portions of the exterior surface 310 of the upper assembly 300 are formed by the first surface 121 of the knit element 100. In example aspects, the lace tunnel 232 of the tongue 200 is located along a midline of the tongue 200 and a midline of the upper assembly 300, as indicated by a midline axis 312 that extends in a direction from the ankle opening 116 of the knit element 100 to the toe area 122.

The medial arm 214 and the lateral arm 218 of the tongue 200 are positioned interior to the knit element 100 and extend from the throat area 118 to the lower area 111 of the knit element 100 along each of the medial side 124 and the lateral side 126. In example aspects, the medial arm 214 and the lateral arm 218 are generally located in a midfoot region of the upper assembly 300 and help to provide support to the area of the wearer's foot located in the midfoot region. For example, the medial arm 214 and the lateral arm 218 may provide support to the instep area and the lateral and medial sides of the wearer's foot in the midfoot region. Moreover, having multiple layers of material (i.e., at least one layer from the knit element 100 and at least one layer from the tongue 200) in the midfoot region of the upper assembly 300 increases resistance to abrasion and may help to limit stretch and wear-and-tear, thereby increasing the useable life of an article of footwear incorporating the upper assembly 300. The medial arm 214 and the lateral arm 218 of the tongue 200 form a portion of the interior surface of the upper assembly in the midfoot region. Remaining portions of the interior surface of the upper assembly 300 are generally formed by the second surface of the knit element 100.

In example aspects, the tongue 200 may be selectively secured to the knit element 100. For example, the medial arm edge 216 of the tongue 200 may be secured to the perimeter edge 110 of the knit element 100 on the medial side 124 of the upper assembly 300, as indicated by the "X" marks 314. The lateral arm edge 220 of the tongue 200 may be secured to the perimeter edge 110 of the knit element 100 on the lateral side 126 of the upper assembly 300, as also indicated by the "X" marks 314. In further example aspects, additionally or alternatively to securement along the perimeter edge 110, the tongue 200 may be secured to the knit element 100 at a forward portion 316 of the throat area 118, as indicated by the "X" marks 314. The securing of the tongue 200 to the knit element 100 may be through stitching, bonding, welding, adhesives, and the like. In example aspects, remaining portions of the tongue 200 are not directly secured to the knit element 100. The result is that the unsecured portions of the tongue 200 are able to shift relative to the knit element 100. This may be helpful in reducing tension forces on the skin of the wearer's foot during use, especially during athletic movements that may result in a sudden change in direction. Additionally, having remaining portions of the tongue 200 unsecured relative to the knit element 100 provides greater flexibility in positioning the tongue 200 when a wearer is donning footwear incorporating the tongue 200 and knit element 100.

As depicted, the tongue 200 is positioned interior to the lace apertures 128 of the knit element 100. When a lace (not shown in FIG. 2 but depicted in FIG. 5) is threaded through the lace apertures 128, the tongue 200 prevents the lace from coming into direct contact with the wearer's foot. This may improve wearer comfort by lessening the pressure of the laces against the wearer's skin surface.

As depicted in FIG. 3A and as further depicted in FIG. 4, at least a portion of the first plurality of aperture groupings 130 of the knit element 100 is generally axially aligned with at least a portion of the second plurality of aperture groupings 224 of the tongue 200 such that at least a portion of the apertures 131 of the knit element 100 and at least a portion of the apertures 226 of the tongue 200 form a continuous through-passage that extends from an interior of the upper assembly 300 to the external environment. This through-passage facilitates the exhaustion of heat and moisture from an inside of the upper assembly 300 to the external environment.

As stated above, aspects herein contemplate that there are a greater number of apertures per unit area in the second plurality of aperture groupings 224 compared to the first plurality of aperture groupings 130. This may serve several purposes. For example, the greater number of apertures per unit area in the second plurality of aperture groupings 224 increases the likelihood that at least a portion of the apertures 226 are axially aligned with at least a portion of the apertures 131, even when the tongue 200 shifts relative to the knit element 100. Having a fewer number of apertures per unit area on the knit element 100 versus the tongue 200 enables the knit element 100 to be more effective in preventing environmental debris (e.g., dust, pebbles, rain, etc.) from entering into the interior of the upper assembly 300. Moreover, having a fewer number of apertures per unit area on the knit element 100 versus the tongue 200 may increase the structural integrity and durability of the knit element 100 due to an increased number of interlooped yarns per unit area. This may be particularly important when considering the knit element 100 forms a majority of the exterior surface of the upper assembly 300.

Figure 3B:
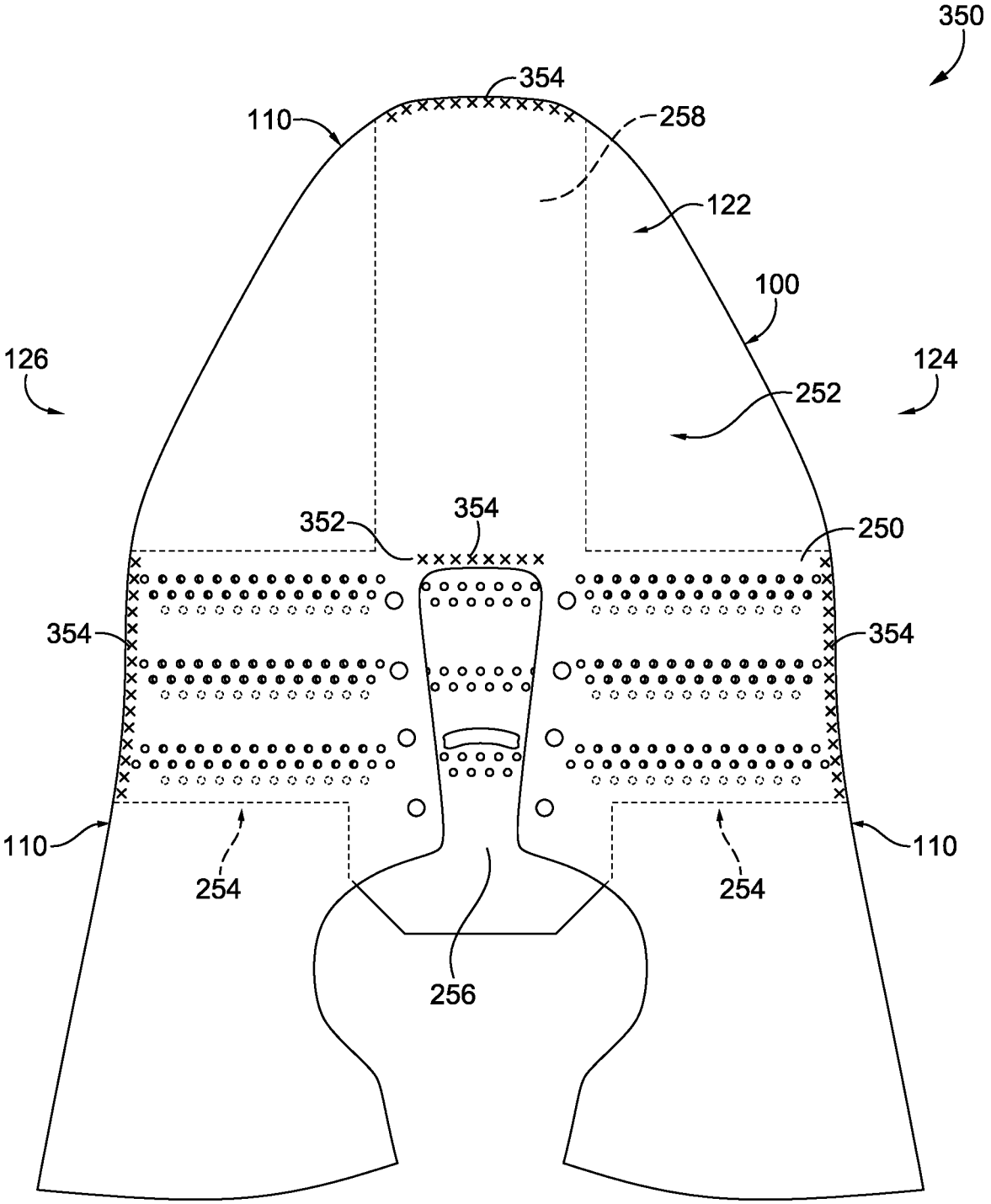
FIG. 3B illustrates a top plan view of the second example tongue of FIG. 2B positioned interior to the knit element of FIG. 1 to form the upper assembly for the article of footwear in accordance with aspects herein.

FIG. 3B depicts an upper assembly 350 that includes the knit element 100 and the tongue 250. FIG. 3B is included to illustrate the placement of the tongue 250 relative to the knit element 100, and, as such, description regarding the aperture groupings has been omitted for clarity. However, aspects herein contemplate that the description of the aperture groupings provided with respect to the upper assembly 300 are equally applicable to the upper assembly 350.

The positioning of the horizontal bar 254 and the proximal portion 256 of the vertical bar 252 is similar to the tongue 200. As depicted, the distal portion 258 of the vertical bar 252 extends into the toe area 122 of the knit element 100 and is positioned internal to the knit element 100. This construction may provide additional reinforcement and increase the durability of the toe area 122 of the upper assembly 350.

Like the tongue 200, the tongue 250 may be secured to the knit element 100 at the lower area 111 and/or perimeter edge 110 on the medial side 124 and on the lateral side 126, and may be further secured to the knit element 100 at a forward portion 352 of the throat area 118, as illustrated by the "X" marks 354. Aspects herein contemplate that the distal portion 258 of the tongue 250 may be secured to the lower area 111 and/or perimeter edge 110 of the knit element 100 in the toe area 122, as further indicated by the "X" marks 354. Remaining areas of the tongue 250 may not be secured to the knit element 100 to allow for some shifting between the tongue 250 and the knit element 100 during wearer movement.

FIG. 4 depicts an example cross-section taken at cut line 4-4 of FIG. 3A. The cross-section is taken at an area where the aperture grouping 130*f* of the knit element 100 is positioned overtop the aperture grouping 224*f* of the tongue 200. As depicted by axis 410, the apertures 131 of the knit element 100 are axially aligned with the apertures 226 of the tongue 200 to form a fluid communication path. Although the apertures 131 and 226 are depicted as being completely aligned (i.e., 100% overlap), aspects herein contemplate that there may be partial overlap between the apertures 131 and 226. For instance, individual apertures 131 and 226 may overlap from about 0% up to about 99%. In one example, individual apertures 131 and 226 overlap an amount within a range of about 10% and about 95%. In another example, individual apertures 131 and 226 overlap an amount within a range of about 20% and about 90%. In another example, individual apertures 131 and 226 overlap an amount within a range of about 30% and about 75%.

FIG. 4 further depicts the different surfaces of the knit element 100 and the tongue 200. The knit element 100 includes the first surface 121 and the opposite second surface 123, and the tongue 200 includes the first surface 222 and the opposite second surface 223. The first surface 121 of the knit element 100 forms the exterior surface 310 of the upper assembly 300 in the area from which the cross-section is taken. The second surface 123 of the knit element 100 is in a face-sharing relationship with the first surface 222 of the tongue 200. The second surface 223 of the tongue 200 forms an interior surface 412 of the upper assembly 300 in the area from which the cross-section is taken.

Figure 5:
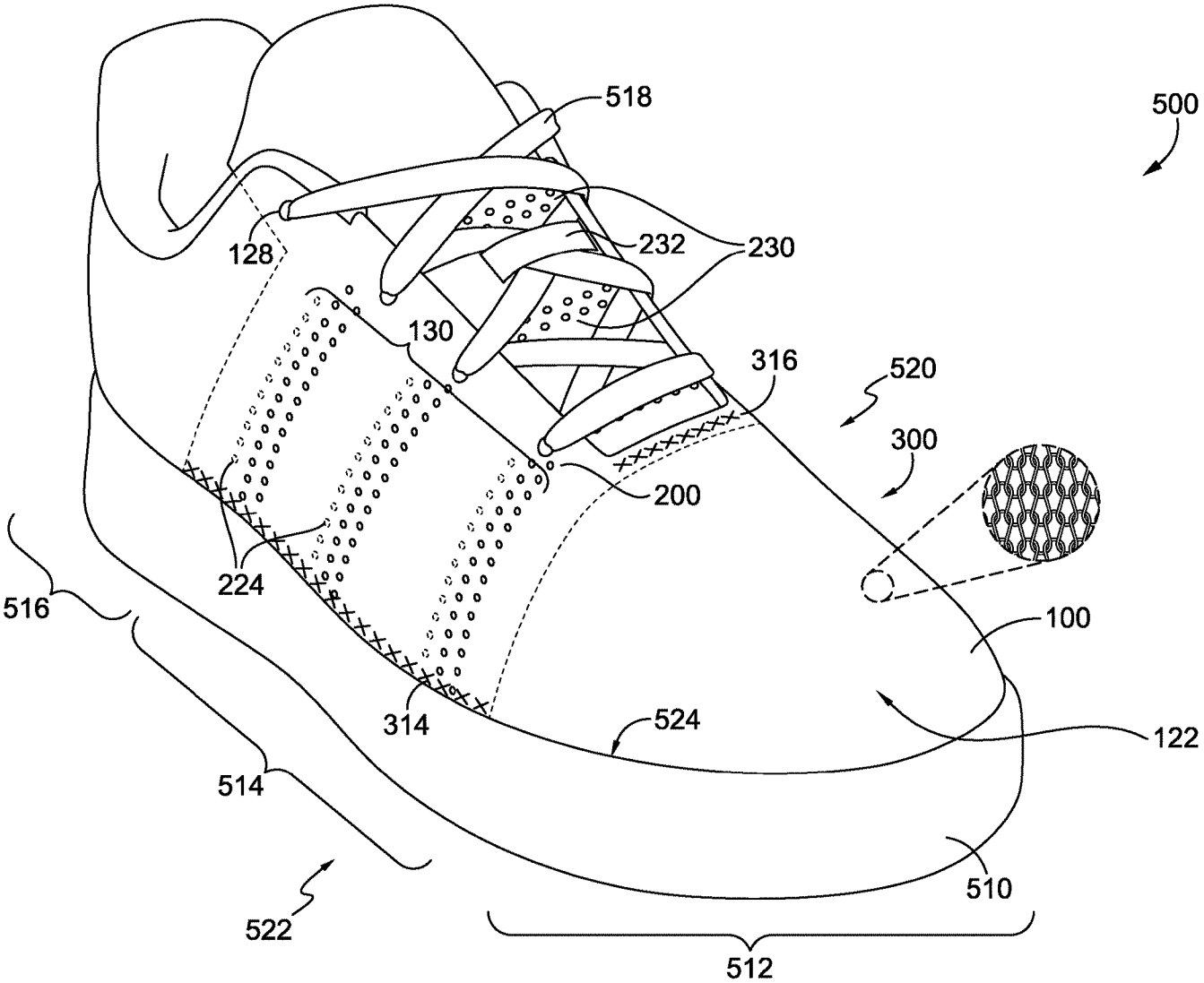
FIG. 5 illustrates a perspective view of an article of footwear incorporating the knit element of FIG. 1 and the tongue of FIG. 2A in accordance with aspects herein.

FIG. 5 depicts a perspective view of an article of footwear 500 that includes the upper assembly 300 comprising the knit element 100 and the tongue 200 positioned interior to the knit element 100 and a sole structure 510 secured to the upper assembly 300. The article of footwear 500 is shown in the form of an athletic shoe, but other types of shoes (e.g., sandals, leisure shoes, and the like) are contemplated herein. The article of footwear 500 includes a forefoot region 512, a midfoot region 514, and a heel region 516, a medial side 520, and a lateral side 522. A lace 518 for adjusting the girth of the article of footwear 500 is depicted extending through the lace apertures 128 and further extending through the lace tunnel 232 located generally at the midline of the tongue 200.

As described, the tongue 200 is selectively secured to the knit element 100 at the lower area of the upper assembly 300 on each of the medial side 520 and the lateral side 522, as shown by the "X" marks 314. In example aspects, the securement location between the tongue 200 and the knit element 100 may correspond approximately (e.g., within +1 cm to 2 cm) to a bite line 524 of the article of footwear 500. As used herein, the term "bite line" is the edge where the upper assembly 300 and a sole structure 510 intersect on the finished article of footwear 500. The tongue 200 may be further secured to the knit element 100 at the forward portion 316 of the throat area 118, while remaining areas of the tongue 200 may not be directly secured to the knit element 100 to allow for shifting between the two layers during wearer movement.

As described, the configuration of the tongue 200 and its selective attachment to the knit element 100 provides additional and adjustable support and stability to the medial side 520 and the lateral side 522 of the article of footwear 500 in at least the midfoot region 514 of the article of footwear 500. Further, the extra layer of material provided by the tongue 200 in the midfoot region 514 may increase the overall durability and resistance to wear-and-tear of the article of footwear 500.

FIG. 5 further depicts the first plurality of aperture groupings 130 on the knit element 100 positioned overtop the second plurality of aperture groupings 224 of the tongue 200 (shown in dashed line to indicate that the aperture groupings 224 are generally hidden from view). The aperture groupings 230 present on the central portion 228 of the tongue 200 are also depicted. The aperture groupings 130, 224, and 230 of the knit element 100 and the tongue 200 work together to increase wearer comfort by providing an exit point for heat and/or moisture vapor to transfer from an interior of the article of footwear 500 to an environment external to the article of footwear 500.

Although not depicted, an article of footwear incorporating the tongue 250 in combination with the knit element 100 is contemplated herein and would have a similar configuration as the article of footwear 500, and would additionally include the distal portion 258 of the tongue 250 in the toe area 122.

Figure 6:
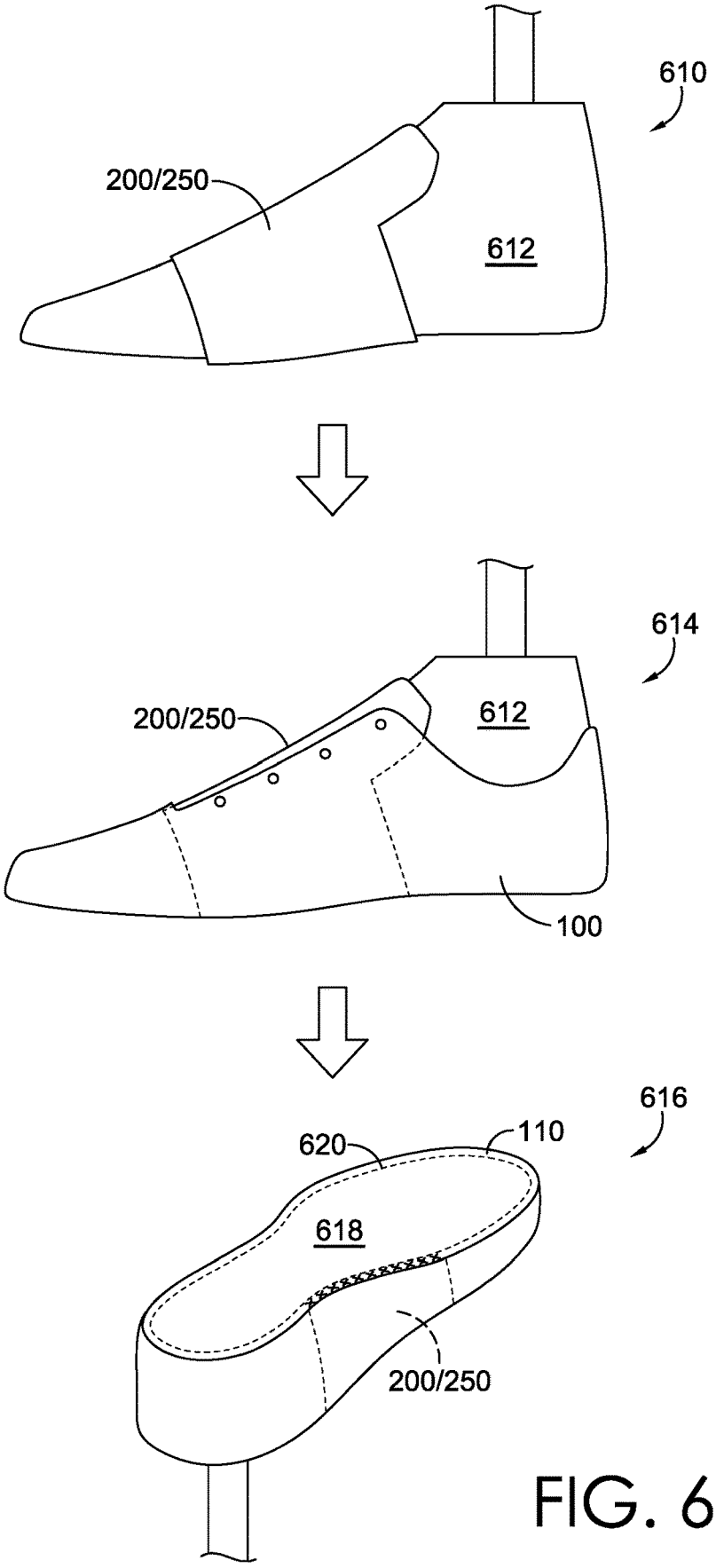
FIG. 6 illustrates a process flow depicting how the tongue and the knit element are layered over a last to form the upper assembly in accordance with aspects herein.

FIG. 6 depicts a schematic of a process flow for manufacturing an upper assembly such as the upper assembly 300 described herein. At a step 610, a tongue, such as the tongue 200 or the tongue 250, is positioned on a shoe last 612. At a step 614, a knit element, such as the knit element 100, is positioned overtop the tongue 200/250 on the shoe last 612. In example aspects, the knit element 100 may be positioned such that a midline of the throat area 118 is aligned with a midline of the tongue 200/250. The positioning of the knit element 100 overtop the tongue 200/250 may further include a registration step where the first plurality of aperture groupings 130 of the knit element 100 is axially aligned with the second plurality of aperture groupings 224 of the tongue 200/250.

At a step 616, the shoe last 612 is inverted and a strobel 618 is stitched to the perimeter edge 110 of the knit element 100, as depicted by stitch line 620. In example aspects, the strobel stitch (e.g., the stitch line 620) may also be used to secure the medial arm edge 216 and the lateral arm edge 220 of the tongue 200/250 to the lower area 111 and/or the perimeter edge 110 of the knit element 100. A sole structure, such as the sole structure 510 may then be secured to the upper assembly 300 to form the article of footwear 500. In an additional step, not depicted, the tongue 200/250 may be further secured to the knit element 100 at the forward portion 316 of the throat area 118. When the tongue has the configuration of the tongue 250, the strobel stitch (e.g., the stitch line 620) may also be used to secure the distal portion 258 of the vertical bar 252 of the tongue 250 to the toe area 122 of the knit element 100. When the tongue has the configuration of the tongue 200, a separate stitch or coupling mechanism may be used to secure a forward edge 215 of the arm 212 of the tongue 200 to the forward portion 316 of the throat area 118 of the knit element 100. Other ways of securing the knit element 100 and the tongue 200/250 to form the upper assembly 300 are contemplated as being within aspects herein.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An article of footwear having an upper assembly and a sole structure secured to the upper assembly, the upper assembly comprising: a knit element defining at least a portion of an exterior surface of the upper assembly, the knit element extending from a throat area to a lower area of the upper assembly along at least a medial side, a lateral side, and a toe area of the upper assembly, the knit element comprising a first plurality of aperture groupings located on at least one of the medial side and the lateral side; and a tongue defining at least a portion of an interior surface of the upper assembly, the tongue extending across the throat area and further extending to the lower area of the upper assembly along at least a portion of the medial side and the lateral side of the upper assembly, the tongue comprising a second plurality of aperture groupings located on at least one of the medial side and the lateral side, the second plurality of aperture groupings axially aligned with at least a portion of the first plurality of aperture groupings.

Clause 2. The article of footwear according to clause 1, wherein the knit element and the tongue are secured to each other at the lower area of the upper assembly.

Clause 3. The article of footwear according to any of clauses 1 through 2, wherein the tongue is secured to the knit element in a forward portion of the throat area.

Clause 4. The article of footwear according to any of clauses 2 through 3, wherein remaining portions of the tongue are not secured to the knit element.

Clause 5. The article of footwear according to any of clauses 1 through 4, wherein the tongue comprises a knit construction.

Clause 6. The article of footwear according to any of clauses 1 through 5, wherein the tongue extends to an ankle opening of the upper assembly.

Clause 7. The article of footwear according to any of clauses 1 through 6, wherein a number of apertures per unit area in the second plurality of aperture groupings is greater than a number of apertures per unit area in the first plurality of aperture groupings.

Clause 8. The article of footwear according to any of clauses 1 through 7, wherein the tongue comprises one or more elastic yarns.

Clause 9. The article of footwear according to any of clauses 1 through 8, wherein the first plurality of aperture groupings and the second plurality of aperture groupings are each located on the medial side and the lateral side.

Clause 10. An upper assembly for an article of footwear, the upper assembly comprising: a knit element defining at least a portion of an exterior surface of the upper assembly, the knit element extending from a throat area to a lower area of the upper assembly along at least a medial side, a lateral side, and a toe area of the upper assembly, the knit element comprising a first set of apertures located on one or more of the medial side and the lateral side; and a tongue defining at least a portion of an interior surface of the upper assembly, the tongue extending across the throat area and further extending to the lower area of the upper assembly along at least a portion of the medial side and the lateral side of the upper assembly, the tongue comprising a second set of apertures on one or more of the medial side and the lateral side, wherein at least a portion of the second set of apertures is axially aligned with at least a portion of the first set of apertures.

Clause 11. The upper assembly according to clause 10, wherein the first set of apertures is arranged in a first plurality of aperture groupings located on one or more of the medial side and the lateral side of the upper assembly.

Clause 12. The upper assembly according to any of clauses 10 through 11, wherein the second set of apertures is arranged in a second plurality of aperture groupings located on one or more of the medial side and the lateral side of the upper assembly.

Clause 13. The upper assembly according to any of clauses 10 through 12, wherein the first set of apertures and the second set of apertures are each located on the medial side and the lateral side.

Clause 14. The upper assembly according to any of clauses 11 through 13, wherein the second plurality of aperture groupings is axially aligned with at least a portion of the first plurality of aperture groupings.

Clause 15. The upper assembly according to any of clauses 10 through 14, wherein the tongue comprises a T-shape, and wherein a stem of the T-shape extends across the throat area and an arm of the T-shape extends across the throat area and to the lower area of the upper assembly along each of the medial side and the lateral side of the upper assembly.

Clause 16. The upper assembly according to any of clauses 10 through 15, wherein the knit element and the tongue are secured to each other at the lower area of the upper assembly.

Clause 17. The upper assembly according to any of clauses 10 through 16, wherein the tongue is secured to the knit element in a forward portion of the throat area.

Clause 18. The upper assembly according to any of clauses 16 through 17, wherein remaining portions of the tongue are not secured to the knit element.

Clause 19. The upper assembly according to any of clauses 10 through 18, wherein the knit element comprises a plurality of lace apertures adjacent the throat area.

Clause 20. The upper assembly according to any of clauses 10 through 19, wherein the tongue includes one or more integrally knit tunnels configured to receive a lace, the one or more integrally knit tunnels located along a midline of the tongue, the midline extending in a direction from an ankle opening of the upper assembly to the toe area of the upper assembly.

Clause 21. A method of manufacturing an upper assembly for an article of footwear, the method comprising: knitting a knit element comprising a throat area, a medial side, a lateral side, and a toe area, the knit element comprising a first set of apertures; knitting a tongue, the tongue comprising a second set of apertures; positioning the tongue interior to the knit element such that the tongue extends across the throat area and further extends interior to at least a portion of the medial side and the lateral side of the knit element, wherein positioning the tongue further comprises positioning the second set of apertures such that the second set of apertures is axially aligned with at least a portion of the first set of apertures; and securing the tongue to the knit element in one or more locations.

Clause 22. The method of manufacturing the upper assembly according to clause 21, wherein the knit element and the tongue are knit in two separate knitting events.

Clause 23. A knit tongue for an article of footwear, the tongue extending across a throat area of an upper assembly and further extending to the lower area of the upper assembly along at least a portion of the medial side and the lateral side of the upper assembly.

Clause 24. The knit tongue of clause 23, wherein the knit tongue comprises a T-shape, and wherein a stem of the T-shape extends across a throat area of the upper assembly, and an arm of the T-shape extends across the throat area and to the lower area of the upper assembly along each of the medial side and the lateral side of the upper assembly.

Clause 25. The knit tongue of any of clauses 23 through 24, where the knit tongue comprises a first set of apertures.

Clause 26. The knit tongue of clause 25, where the first set of apertures are located in the arm of the T-shape.

Clause 27. The upper assembly comprising the knit tongue of any of clauses 23 through 26 and a knit element defining at least a portion of an exterior surface of the upper assembly, the knit element extending from the throat area to the lower area of the upper assembly along at least a medial side, a lateral side, and a toe area of the upper assembly, the knit element at least partially overlaying the knit tongue.

Clause 28. The upper assembly of clause 27, wherein the knit tongue includes a first set of apertures and the knit element comprises a second set of apertures located on one or more of the medial side and the lateral side, wherein at least a portion of the second set of apertures is axially aligned with at least a portion of the first set of apertures.

Clause 29. The upper assembly of any of clauses 27 through 28, wherein the knit tongue is secured to the knit element in a forward portion of the throat area.

Clause 30. The upper assembly of any clauses 27 through 29, wherein remaining portions of the knit tongue are not secured to the knit element.

Clause 31. An article of footwear comprising an upper assembly secured to a sole structure, the upper assembly comprising the knit tongue of any of the clauses 23 through 26.

Clause 32. An article of footwear comprising the upper assembly of any of the clauses 27 through 30, and a sole structure secured to the upper assembly.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of footwear having an upper assembly and a sole structure secured to the upper assembly, the upper assembly comprising:

a knit element defining at least a portion of an exterior surface of the upper assembly, the knit element extending from a throat area to a lower area of the upper assembly along at least a medial side, a lateral side, and a toe area of the upper assembly, the knit element comprising a first plurality of aperture groupings located on one or more of the medial side and the lateral side; and a tongue defining at least a portion of an interior surface of the upper assembly, the tongue extending across the throat area and further extending to the lower area of the upper assembly along at least a portion of the medial side and the lateral side of the upper assembly, the tongue comprising a second plurality of aperture groupings located on one or more of the medial side and the lateral side, the second plurality of aperture groupings axially aligned with at least a portion of the first plurality of aperture groupings.

2. The article of footwear of claim 1, wherein the knit element and the tongue are secured to each other at the lower area of the upper assembly.

3. The article of footwear of claim 2, wherein the tongue is secured to the knit element in a forward portion of the throat area.

4. The article of footwear of claim 3, wherein remaining portions of the tongue are not secured to the knit element.

5. The article of footwear of claim 1, wherein the tongue comprises a knit construction.

6. The article of footwear of claim 1, wherein the tongue extends to an ankle opening of the upper assembly.

7. The article of footwear of claim 1, wherein a number of apertures per unit area in the second plurality of aperture groupings is greater than a number of apertures per unit area in the first plurality of aperture groupings.

8. The article of footwear of claim 1, wherein the tongue comprises one or more elastic yarns.

9. An upper assembly for an article of footwear, the upper assembly comprising:

a knit element defining at least a portion of an exterior surface of the upper assembly, the knit element extending from a throat area to a lower area of the upper assembly along at least a medial side, a lateral side, and a toe area of the upper assembly, the knit element comprising a first set of apertures located on one or more of the medial side and the lateral side; and a tongue defining at least a portion of an interior surface of the upper assembly, the tongue extending across the throat area and further extending to the lower area of the upper assembly along at least a portion of the medial side and the lateral side of the upper assembly, the tongue comprising a second set of apertures on one or more of the medial side and the lateral side, wherein at least a portion of the second set of apertures is axially aligned with at least a portion of the first set of apertures.

10. The upper assembly of claim 9, wherein the first set of apertures is arranged in a first plurality of aperture groupings located on one or more of the medial side and the lateral side of the upper assembly.

11. The upper assembly of claim 10, wherein the second set of apertures is arranged in a second plurality of aperture groupings located on one or more of the medial side and the lateral side of the upper assembly.

12. The upper assembly of claim 11, wherein the second plurality of aperture groupings is axially aligned with at least a portion of the first plurality of aperture groupings.

13. The upper assembly of claim 9, wherein the tongue comprises a T-shape, and wherein a stem of the T-shape extends across the throat area and an arm of the T-shape extends across the throat area and to the lower area of the upper assembly along each of the medial side and the lateral side of the upper assembly.

14. The upper assembly of claim 9, wherein the knit element and the tongue are secured to each other at the lower area of the upper assembly.

15. The upper assembly of claim 14, wherein the tongue is secured to the knit element in a forward portion of the throat area.

16. The upper assembly of claim 15, wherein remaining portions of the tongue are not secured to the knit element.

17. The upper assembly of claim 9, wherein the knit element comprises a plurality of lace apertures adjacent the throat area.

18. The upper assembly of claim 17, wherein the tongue includes one or more integrally knit tunnels configured to receive a lace, the one or more integrally knit tunnels located along a midline of the tongue, the midline extending in a direction from an ankle opening of the upper assembly to the toe area of the upper assembly.

19. A method of manufacturing an upper assembly for an article of footwear, the method comprising:

knitting a knit element comprising a throat area, a medial side, a lateral side, and a toe area, the knit element comprising a first set of apertures;

knitting a tongue, the tongue comprising a second set of apertures;

positioning the tongue interior to the knit element such that the tongue extends across the throat area and further extends interior to at least a portion of the medial side and the lateral side of the knit element, wherein positioning the tongue further comprises positioning the second set of apertures such that the second set of apertures is axially aligned with at least a portion of the first set of apertures; and securing the tongue to the knit element in one or more locations.

20. The method of manufacturing the upper assembly of claim 19, wherein the knit element and the tongue are knit in two separate knitting events.

* * * * *